United States Patent [19]

Theis

[11] Patent Number: 4,727,639

[45] Date of Patent: Mar. 1, 1988

[54] METHOD OF MANUFACTURING SUBCALIBER SEGMENTED SABOT PROJECTILE

[75] Inventor: Ulrich Theis, Muehlheim, Fed. Rep. of Germany

[73] Assignee: Rheinmetall GmbH, Duesseldorf, Fed. Rep. of Germany

[21] Appl. No.: 799,335

[22] Filed: Nov. 18, 1985

Related U.S. Application Data

[63] Continuation-in-part of Ser. No. 291,825, Aug. 10, 1981, Pat. No. 4,565,132.

[30] Foreign Application Priority Data

Aug. 9, 1980 [DE] Fed. Rep. of Germany ..... 3030072

[51] Int. Cl.[4] ..... B23P 17/00

[52] U.S. Cl. ..... 29/421 E; 29/1.2; 29/456; 102/517; 102/521; 228/107

[58] Field of Search ..... 29/421 E, 1.2–1.22, 29/456, 1.23; 102/520, 520 R, 517, 521, 522, 523; 228/107, 108

[56] References Cited

U.S. PATENT DOCUMENTS

| | | | |
|---|---|---|---|
| 3,364,561 | 1/1968 | Barrington | 228/108 |
| 3,449,819 | 6/1969 | Blank | 29/421 E |
| 3,461,698 | 8/1969 | Bennett | 299/421 E |
| 3,620,167 | 11/1971 | Romer et al. | 102/521 |
| 3,646,792 | 3/1972 | Hertel et al. | 29/421 E |
| 3,859,922 | 1/1975 | Kaplan et al. | 102/521 |
| 4,351,094 | 9/1982 | Haberli | 29/1.2 |
| 4,372,217 | 2/1983 | Kirkendall et al. | 102/521 |
| 4,517,899 | 5/1985 | Haberli | 102/521 |
| 4,527,483 | 7/1985 | Eichweber | 102/521 |
| 4,547,949 | 10/1985 | Heller et al. | 29/421 E |
| 4,564,226 | 1/1986 | Doherty | 29/421 E |
| 4,671,181 | 6/1987 | Romer et al. | 102/521 |

FOREIGN PATENT DOCUMENTS

| | | | |
|---|---|---|---|
| 118999 | 9/1944 | Australia | 102/521 |
| 2471835 | 6/1981 | France | 228/107 |
| 2069393 | 8/1981 | United Kingdom | 228/107 |

*Primary Examiner*—Charlie T. Moon

[57] ABSTRACT

Form-locking means and process for joining same to a subcaliber projectile in a peripheral region thereof. The form-locking means consists of a material in the form of a n-phase sintered alloy having a high content of at least one heavy metal, wherein n≧2. The material forming the form locking means in the peripheral region of the subcaliber projectile form at least one further alloy phase. The form-locking means includes interlocking lands and grooves, and are joined to the periphery of the subcaliber projectile in the form of a layer of predetermined thickness which can be joined to the projectile surface by means of explosion welding.

5 Claims, 7 Drawing Figures

$\beta = 19.5°$ $V_K = 2120$ m/s $\beta = 22.7°$ $V_K = 2480$ m/s $\beta = 31.0°$ $V_K = 2880$ m/s

METHOD OF MANUFACTURING SUBCALIBER SEGMENTED SABOT PROJECTILE

CROSS-REFERENCE TO RELATED APPLICATION

This application is a continuation-in-part of application Ser. No. 291,825, filed Aug. 10, 1981, now U.S. Pat. No. 4,565,132.

BACKGROUND OF THE INVENTION

The invention encompasses a subcaliber segmented sabot projectile consisting of a penetrator made of heavy metal, a disposable segmented sabot surrounding the penetrator, and a form-locking medium, as for example, a layer of interlocking lands and grooves, such as a thread, between the segmented sabot and penetrator.

The invention further encompasses a process for the manufacture of such a subcaliber segmented sabot projectile.

Subcaliber segmented sabot projectiles primarily serve to combat armored targets by way of kinetic energy. The releasable kinetic energy into the target of the projectile is proportional to the velocity and the mass of the projectile. Since the volume of the projectile is limited by the dimensions of the shell and its gun barrel, the use of materials with high density are preferable as projectile material, in order to make available the greatest possible mass. As materials with high density, sintered alloys can be used with a high percentage of at least one heavy metal, preferably tungsten. The disposable segmented sabot transfers the pressure of the propellant charge gases onto the projectile in order to accelerate it. For this purpose there must exist form locking shapes and/or mediums between the disposable segmented sabot and the circumference of the subcaliber projectile.

Such form locking mediums, for example, in the form of a thread or in the form of grooves, are already known in the U.S. Pat. No. 3,620,167. Threads or grooves can, however, lead to the drawback of undesirable notch effects in the projectile body, since they weaken the resistance (strength) of the projectile body. At impact of the projectile body on the target the projectile can break up into numerous pieces. A broken projectile body, however, can no longer penetrate through the target.

The invention has the basic purpose of providing a subcaliber segmented sabot projectile with a penetrator comprised of heavy metal, a disposable segmented sabot surrounding the penetrator, and a form-lock medium in the form of a layer between the segmented sabot and penetrator, the penetrator containing a high percentage of preferably tungsten in a n-phased sintered alloy (where n=2), characterized by, that the layer carrying the form-locking medium forms at least an additional phase in the circumference of the penetrator which has improved form-locking means. Further, the invention has the purpose of providing a process for the manufacture of such a projectile.

A favorable development of the invention as well as the process for the manufacture of the subcaliber projectile arises out of the facts that preferably said layer contains a light metal, preferably aluminum or magnesium, and that the said layer, in which phases of the form-locking medium are found adjacent to phases of the projectile comprised of heavy metal, has a thickness between 5 micrometers and 30 micrometers, and that the material of the form-locking medium is bonded together with the material of the projectile core by means of explosion welding.

The selection of material for the form-locking medium does not adversely influence the target effective specific density of the flying projectile. The material of the form locking medium, which has a relatively low melting point, will, in fact, upon impact of the projectile onto the target, and the penetration of the same through the target, be smeared by the resulting high temperature and therefore produce no noticeable resistance when the projectile penetrates through the target material. These characteristics provide for particularly good results with regard to the projectile when combatting a target consisting of numerous (armored) plates. The specified process for the arrangement of form-locking mediums allows for a very minimal energy and material consumption, and favorably guarantees, by preventing every temperature and heat determined influence of the sintered joint of the form-locking medium, a secure bonded connection with the projectile. The invention is further explained with reference to the accompanying drawings in which:

DETAILED DESCRIPTION

Figure 1:
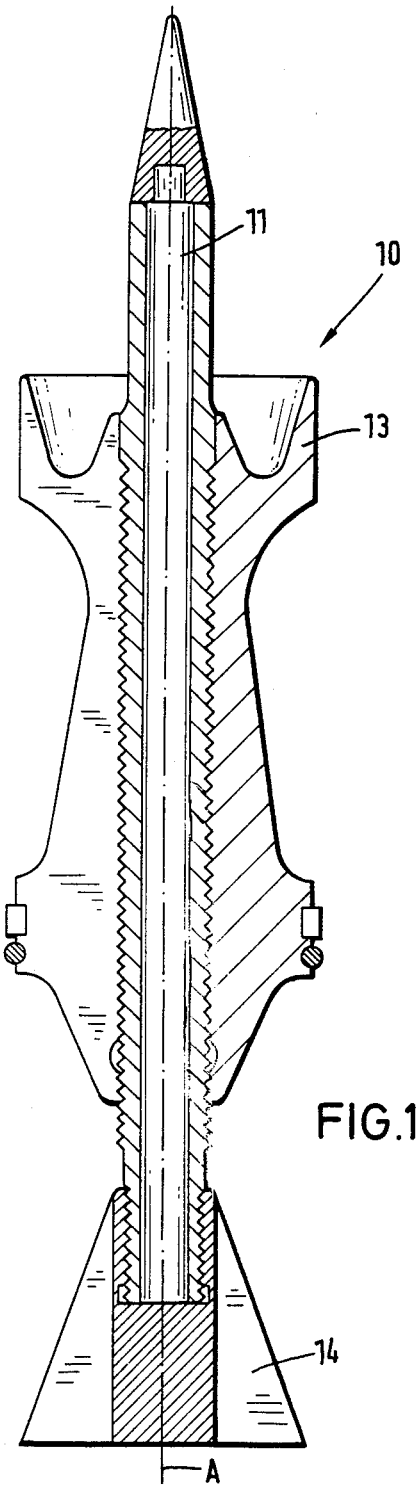
FIG. 1 is a view partially in longitudinal cross section and partially in side elevation of the projectile.

FIG. 1 shows, in partial cross section and partial side view, a subcaliber segmented sabot projectile 10 having a longitudinal axis A. This is comprised of a subcaliber projectile 11, which carries a horizontal stabilizer (tail unit) 14 for stabilization purposes, and which, for a portion of its length, is coaxially surrounded with a disposable segmented sabot 13, preferably comprised of three segments, in order to fire it out of a gun barrel.

The segmented sabot 13 separates itself from the projectile 11 after the firing of the projectile. The segmented sabot 13 serves to transfer the pressure of the propellant loading gas onto the projectile 11 in order to accelerate it to its maximum speed. For this purpose, form locking mediums are provided between the segmented sabot 13 and the projectile 11, which are developed in accordance with the invention.

Figure 2:
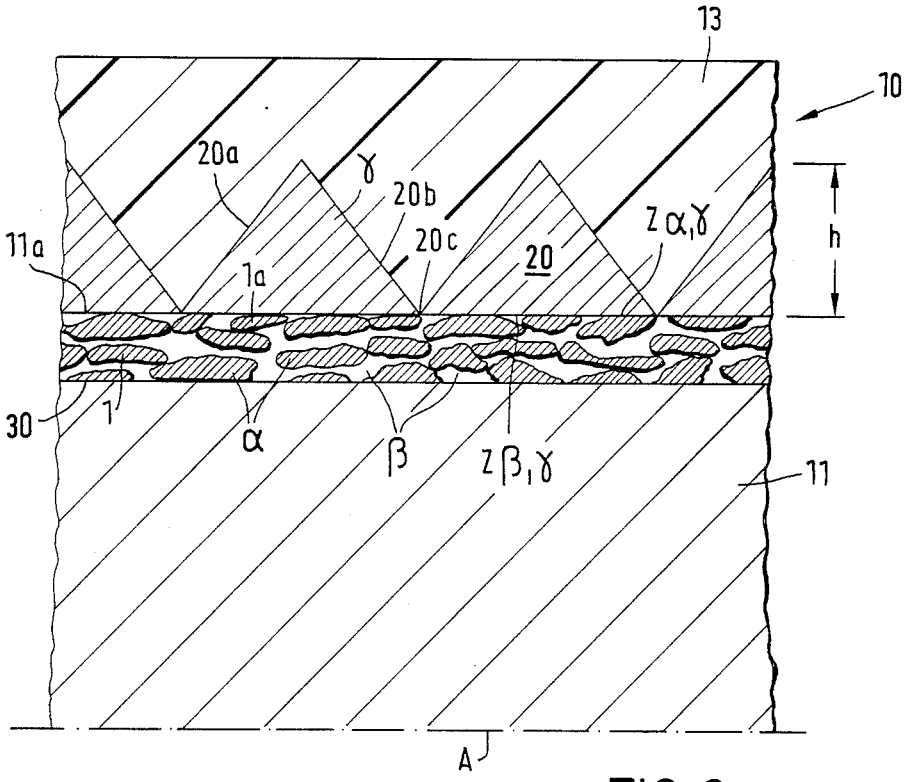
FIG. 2 is a schematically enlarged representation of a sectional part of the projectile according to FIG. 1 with form locking mediums shown in cross section parallel to the longitudinal axis A of the projectile.

On the circumference 30 of the projectile 11, which is comprised of a sintered alloy with a high percentage of tungsten, there is recognizable, next to the phase $\alpha$ (tungsten) and $\beta$ (iron-nickel) of the sintered alloy, an additional phase $\gamma$ (FIG. 2). The phase $\gamma$ is attributable to an aluminum alloy which is placed on the circumference 30 of the projectile 11 onto the circumferential surface 11*a* thereof in a layer 20 and with a thickness of h. A form-locking medium, in the form of mating lands and grooves, specifically threads with flanks 20*a* and 20*b* and a thread base 20*c*, formed like a thread part, is already cut out of the layer 20. An outer (external) limitation of the phase $\beta$ shows a depression between, for example, two observed tungsten granules 1 and 1a, which is filled in by the phase $\gamma$, so that one can speak of an "anchoring" of the material 20 in the sintered alloy. This can be recognized from the position of a phase interface Z $\alpha$, $\gamma$ to a phase interface Z $\beta$, $\gamma$. In the aforementioned double phased sintered alloy an iron-nickel alloy forms the phase $\alpha$ as a bonding agent for the tungsten granule phase which is designated by $\beta$. The choice of the materials employed can proceed under the consideration of the following requirements. They must have sufficient physical properties in order to guarantee a reliable form lock between the segmented sabot and the flying projectile; it must be simple to process; it must be applicable in such a way, with representable effort, as to avoid disturbances in the sintered structure, for example, through overheating. Here, for example, light metal alloys with predominantly aluminum or magnesium components are available. The named components each has an inherently comparably low melting temperature. The required physical properties of corresponding alloys can be brought about by way of work-hardening or heat treatment. In addition, alloy smelting can be applied with a minimum of effort to the required thickness of the layer or to a great extent in the desired form, i.e., for example, as thread bands. The process can, for example, involve die casting (with regard to extending the choice of materials to alloys particularly suited for this process), flame spray, and in particular explosion welding.

A further advantage results from the softening range of the respective form-locking material employed, which extends to comparably low temperatures. No later than at the time of penetration through the target, does the form-locking material 20, in view of the resulting heat with sufficient high temperature, lose its physical strength and is literally smeared; so that the cross sectional surface of a sintered body 11 showing a high density, will independently become target effective. This has proven to be particularly advantageous with targets of numerous plates, which can be successfully penetrated in this manner.

A particularly favorable procedure for the manufacture of the form-locking medium, according to the invention, is explosion welding. This is explained in connection with FIGS. 6 and 7. The results which are achieved with explosion welding are explained in connection with the enlarged micrographs in FIGS. 3–5.

Through explosion welding it is possible to join a series of materials with one another, which could not be joined through other welding procedures. Even materials with greatly differing melting points, densities, and hardening values, as for example, with lead and steel or aluminum and niobium, can be joined through explosion welding.

Figure 7:
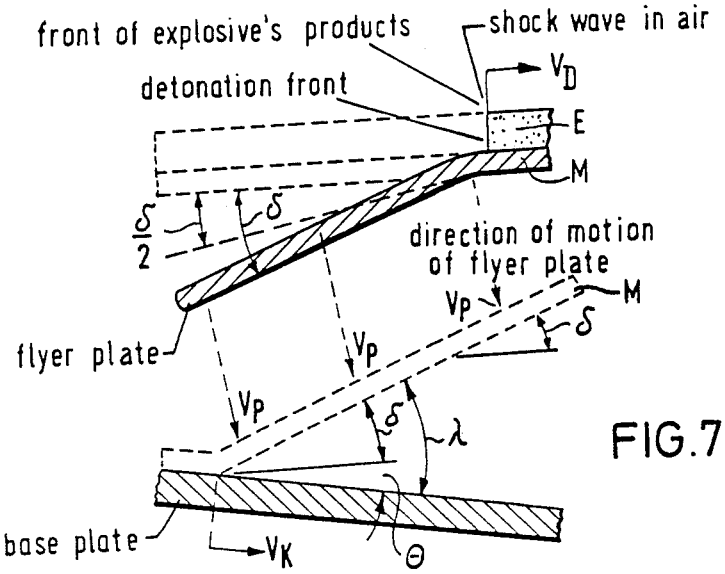

With the above identified projectile, explosion welding succeeds in making a joint between the projectile 11, comprised of tungsten alloy, and a layer of aluminum to be joined around its circumference; which serves as a form-locking medium between the projectile and the segmented sabot. A schematic arrangement for the procedure of explosion welding of metal plates is shown in FIG. 7. A so-called flyer plate with a mass M is covered with a suitable explosive material of an amount E and is positioned over the base plate at a certain distance and an angle $\theta$. After introduction by means of a detonator, the detonation spreads in a grazing fashion over the flyer plate with a speed $v_D$. The high detonation pressure creates a nearly instant acceleration of the flyer plate within a few microseconds to the speed $v_p$. A collision occurs with the base plate under the collision angle. The following simple geometric equations result between the aforementioned values:

plate speed $$v_p = 2\, v_D \sin \delta/2 \tag{1}$$

collision angle $$\beta = \theta + \delta \tag{2}$$

collision speed $$v_K = (\sin \delta / \sin \lambda) \cdot v_D \tag{3}$$

The required values, detonation speed $v_D$ and dynamic bending angle $\delta$, for the computation of the parameter, can be determined with relative ease. The detonation speed $v_D$ is essentially dependent upon the type of explosive material, and with layers of small thickness, also dependent on the amount of explosive material. Its determination results by means of inserted electrical probes in the explosive material and with a counter, for example, a cathode-ray oscilloscope according to the transition time process.

The dynamic bending angle $\delta$ can be determined with either ultra high speed cinematography or x-ray flask technology with larger amounts of explosive, one can make expedient use of the procedure using an electric resistance wire, which will be continuously short-circuited when contact is made with the flight plate. This method allows for the simultaneous determination of the dynamic bending angle $\delta$ the plate speed $v_p$ and its collision angle $\lambda$, as well as the collision speed $v_K$. For sufficiently thin flight plates, it could be shown that the dynamic bending angle according the equation $$\delta = 2 \text{ arc sin. } 0.6. \sqrt{1 + \frac{27E}{32M}} - 1 \quad \sqrt{1 + \frac{27E}{32M}} + 1 \tag{4}$$

can be determined from the amounts of explosive introduced and the mass of the flight plate with the simple ratio E/M.

A device for the manufacture of form locking mediums through explosive welding is further explained in connection with FIG. 6. A projectile core 61 comprised of tungsten alloy is coaxially arranged within a tube 60 comprised of polyvinylchloride (PVC), whose front side is closed of with rings 62, respectively 62a, which likewise are comprised of PVC. The projectile core 61 rests on a plate 63 comprised of steel and is surrounded by a tube 64 comprised of aluminum, which on one end is closed of by a cap 64a which likewise is comprised of aluminum. The explosive 65 required for the performance of the explosion welding is poured into the annulus formed between the inner wall of the PVC tube 60 and the outer wall of the aluminum tube 64. In a demonstration of the invention, the PVC tube 60 had a thickness of 6 mm and an inner diameter of 60 mm. The annular gap for receiving the explosive 65, had a width of 20 mm. The explosive 65 was poured to dumping heights of 10 to 50 mm. A mixture of 50% weight each of "Ammonite 1" "Carbonite C" was used as explosive 65, whereby the packing density of this mixture was set at approximately 1.0 g/cm$^3$.

The initiation of the detonation resulted at the upper end, so that an annular detonation front could run along, in an axial direction, over the aluminium tube 64, and which then accelerated in a radial direction against the projectile core 61 comprised of tungsten heavy metal.

Since flyer and base plates are essentially arranged parallel to each other in the arrangement according FIG. 6, the aforementioned equations (2) and (3) are simplified as follows:

$$\lambda=\delta \text{ (collision angle=dynamic bending angle)} \quad (2a)$$

$$v_K=v_D \text{ (collision speed=detonation speed)} \quad (3a).$$

Figure 4:
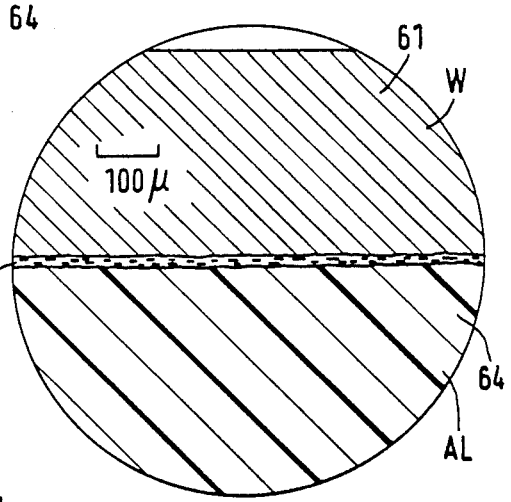
Figure 5:
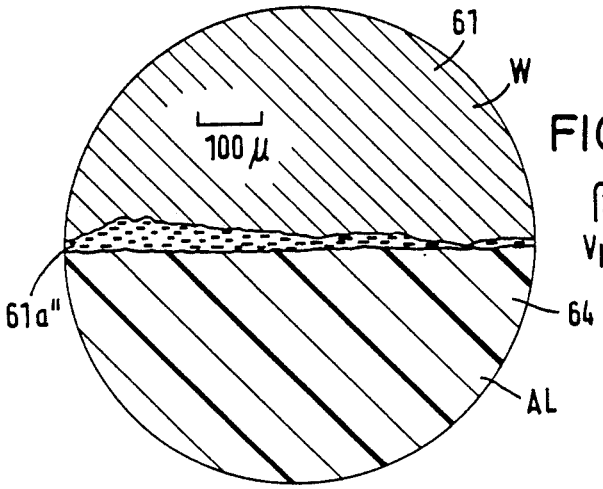
Figure 6:
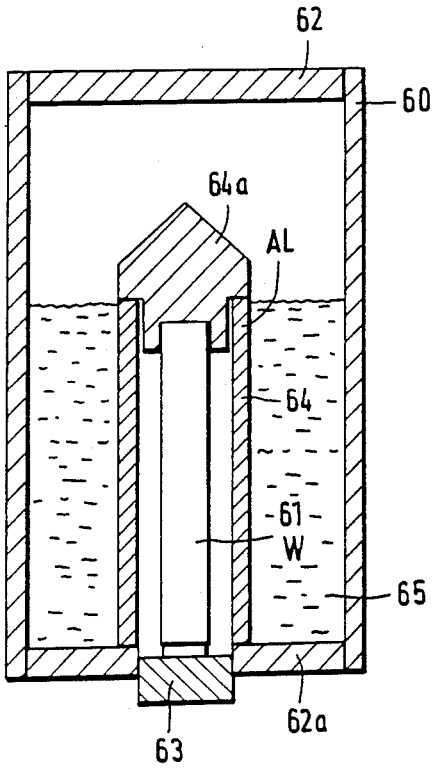
FIG. 6 is a view in vertical axial cross section of a device for the manufacture of the form-locking medium using explosion welding and FIG. 7 is a graphic explanation of the explosion welding process.

The practical results arrived at by way of the construction according FIG. 6, are explained in connection with FIGS. 3–5. Shown here are, respectively, micrographs of the joint layer created through the explosion welding between the heavy metal tungsten of the projectile core 11 (respectively 61) and the aluminum layer 20 (respectively 64). The micrographs of the joint layer show their microstructure enlarged 25 times. Numerous investigations have shown that a joining can be achieved up to a collision speed $v_K$=4,200 m/s. Optimal physical strength values, however, can be achieved much more readily at a collision speed $v_K$ between 2,100 m/s and 2,900 m/s.

Figure 3:
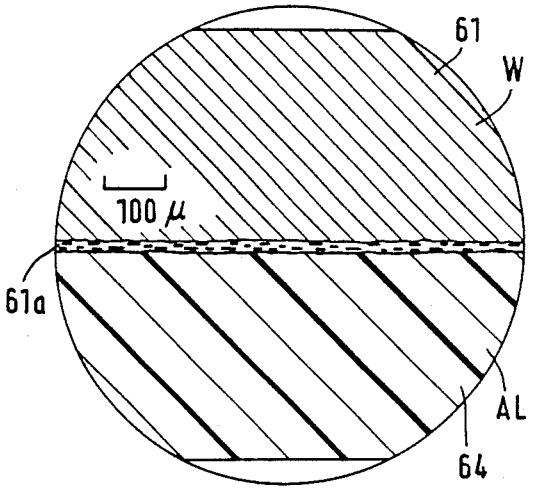
FIGS. 3 through 5, inclusive, are enlarged micrographs of the structure of the form-locking medium.

The micrograph according to FIG. 3, shows a joint layer 61*a*, which was arrived at with a collision angle of 19.5° and collision speed of 2,120 m/s. The joint layer 61*a'*, which was arrived at with a collision angle of 22.7° and a collision speed of 2,480 m/s. The joint layer 61*a'* has a mean thickness between 5 and 15 micrometers.

Finally, the micrograph of the joint layer 61*a''* in FIG. 5 was achieved with a collision angle of 31° and a collision speed of 2,880 m/s. The joint layer 61*a''* partially achieves a thickness of up to 30 micrometers. Particularly, favorable in the latter results is the fact that the joint layer 61*a''* appears in an island shaped form, and, therefore, comes close to the joint layers of true metal-to-metal bonds between the material of the projectile core 61 and the material of the aluminum tube 64.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. Process for the manufacture of joint formed by a form-locking medium between a subcaliber segmented sabot and a subcaliber penetrator projectile made of heavy metal comprising the steps of placing a layer carrying form-locking lands and grooves on the surface of the penetrator projectile core, the penetrator containing a high percentage of a heavy metal in an n-phased sintered alloy (where n=2), the said layer carrying the form-locking medium forming at least an additional phase in the circumference of the penetrator, bonding the material of the form-locking medium together with the material of the projectile core by means of explosion welding, and interlocking a subcaliber segmented sabot to the lands and grooves bonded on the penetrator projectile core.

2. Process according to claim 1, wherein in the execution of the explosion welding and the joining of the material tungsten heavy metal/aluminum a collision speed is used between 1500 m/s and 4200 m/s.

3. Process according to claim 1, wherein in the execution of the explosion welding collision angles are set between 15° and 40°.

4. Process according to claim 1, wherein in the execution of the welding and the joining of the materials tungsten heavy metal/aluminum a collision speed is used between 2100 m/s and 2900 m/s.

5. Process according to claim 1, wherein in the execution of the explosion welding collision angels are set between 19.5° and 31°.

* * * * *